US008170446B2

(12) United States Patent
Matsui et al.

(10) Patent No.: US 8,170,446 B2
(45) Date of Patent: May 1, 2012

(54) IMAGE-FORMING APPARATUS

(75) Inventors: Toshiyuki Matsui, Ebina (JP); Hiroki Ando, Ebina (JP); Satoshi Honobe, Ebina (JP); Tsuneo Fukuzawa, Ebina (JP); Tomonori Sato, Ebina (JP); Fumiaki Maekawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 67 days.

(21) Appl. No.: 12/796,317

(22) Filed: Jun. 8, 2010

(65) Prior Publication Data

US 2011/0123217 A1 May 26, 2011

(30) Foreign Application Priority Data

Nov. 20, 2009 (JP) ..... 2009-264634

(51) Int. Cl.
*G03G 21/18* (2006.01)

(52) U.S. Cl. ..... 399/114; 399/112; 399/117

(58) Field of Classification Search ..... 399/107, 399/110–112, 114, 116, 117, 124
See application file for complete search history.

(56) References Cited

U.S. PATENT DOCUMENTS

2004/0170446 A1 9/2004 Nagashima et al.
2005/0008393 A1 * 1/2005 Kuma et al. ..... 399/110
2005/0220481 A1 10/2005 Yamaguchi et al.
2005/0281594 A1 12/2005 Kuma et al.
2006/0239712 A1 10/2006 Yamaguchi et al.
2006/0285879 A1 12/2006 Yamaguchi et al.
2007/0160383 A1 * 7/2007 Matsumoto et al. ..... 399/110
2009/0180799 A1 7/2009 Yamaguchi et al.

FOREIGN PATENT DOCUMENTS

JP 2004-212986 A 7/2004
JP 2005-266781 A 9/2005
JP 2006-003735 A 1/2006

* cited by examiner

*Primary Examiner* — David Porta
*Assistant Examiner* — Benjamin Schmitt
(74) *Attorney, Agent, or Firm* — Sughrue Mion, PLLC

(57) ABSTRACT

An image-forming apparatus includes: image-holding members each holding an image and being rotatable around a rotation shaft; a frame member that partially defines a space for accommodating the image-holding members; a cover that opens and closes the space, an inner side of the cover having rotation shaft insertion holes; a supporting shaft that supports the cover so the cover is pivotable with respect to the frame member; and a positioning mechanism that positions the cover when the cover closes the space. The positioning mechanism includes at least two projections that project from either the frame member or the cover and are spaced apart in a direction of an axis of the supporting shaft such that lengths of perpendicular line segments from the two projections to the axis of the supporting shaft are different from each other. Projection insertion holes receive the corresponding projections when the cover is closed.

10 Claims, 9 Drawing Sheets

70
71
63
62
65
60
Z(+)
X
Y(+)
Z(-)
Y(-)

80
83
81
82
2
3
47
91A
99
43
93A
61
3A
72
72
91B
46
93B
70
70
96
Z(+)
Y(+)
X(+)
X(-)
Y(-)
Z(-)

IMAGE-FORMING APPARATUS

CROSS-REFERENCE TO RELATED APPLICATIONS

This application is based on and claims priority under 35 U.S.C. 119 from Japanese Patent Application No. 2009-264634, which was filed on Nov. 20, 2009.

BACKGROUND

1. Technical Field

The present invention relates to an image-forming apparatus.

2. Related Art

In an image-forming apparatus it is required that an image-holding member that holds an image be precisely positioned.

SUMMARY

In one aspect of the present invention, there is provided an image-forming apparatus including: plural image-holding members, each image-holding member holding an image and being rotatable around a rotation shaft; a frame member that at least partially defines a space for accommodating the plural image-holding members therein; a cover provided to the frame member to open and close the space with respect to an outside, an inner side of the cover being formed with rotation shaft insertion holes each for receiving an end portion of the rotation shaft of a corresponding one of the image-holding members accommodated in the space; a supporting shaft that supports the cover such that the cover is pivotable with respect to the frame member; and a positioning mechanism that positions the cover with respect to the frame member when the cover closes the space, the positioning mechanism including at least two projections that project from one of the frame member and the cover and that are spaced apart from each other in a direction of an axis of the supporting shaft such that lengths of perpendicular line segments from the at least two projections to the axis of the supporting shaft are different from each other, and projection insertion holes provided to the other one of the frame member and the cover to receive corresponding projections when the cover closes the space.

BRIEF DESCRIPTION OF THE DRAWINGS

Exemplary embodiments of the present invention will now be described in detail with reference to the following figures, wherein.

DETAILED DESCRIPTION

1. Exemplary Embodiment

Figure 1:
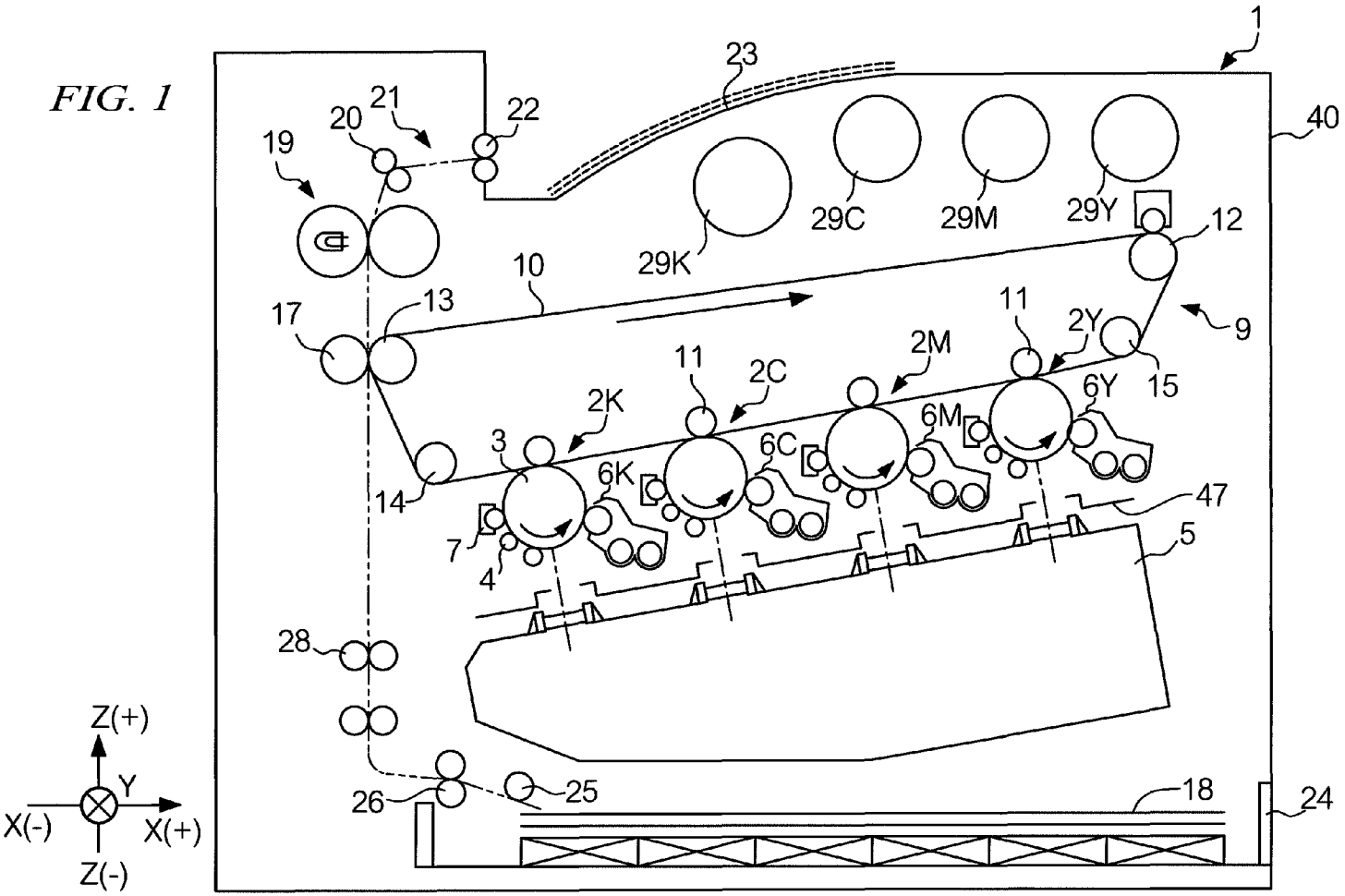
FIG. 1 is a schematic view showing a configuration of an image-forming apparatus according to an exemplary embodiment of the present invention.

An image-forming apparatus, such as a printer or a copy machine, is provided with a cover on a side of a housing, for example, in such a manner that the cover can be opened and closed to facilitate maintenance or replacement of a component part, or removal of a jammed sheet. In the following, taking such an image-forming apparatus as an example, explanation will be made of an exemplary embodiment of the present invention. FIG. 1 schematically shows a configuration inside a main body of the image-forming apparatus.

In the following description, as indicated in the drawings, when the image-forming apparatus is viewed from its front by a user, the horizontal direction is denoted as the X-axis direction, with right/left directions from the user's perspective being indicated by X(+) and X(−), respectively; the front-back direction of the image-forming apparatus is denoted as the Y-axis direction, with back/front directions of the image-forming apparatus being indicated by Y(+) and Y(−), respectively; and the vertical direction is denoted as the Z-axis direction, with up/down directions being indicated by Z(+) and Z(−), respectively.

<Configuration of Image-Forming Apparatus>

First, explanation will be made of an example of an internal configuration and operation of image-forming apparatus 1. Image-forming apparatus 1 is adapted to constitute a full-color printer, and contains an image-processing unit (not shown in the drawings) that performs image-processing on image data received from a device such as a scanner or a personal computer (not shown in the drawings), or received via a telephone line (not shown in the drawings), etc. Provided inside image-forming apparatus 1 are four image-forming units 2Y, 2M, 2C, 2K for yellow (Y), magenta (M), cyan (C), and black (K), respectively. Image-forming units 2Y, 2M, 2C, 2K are arranged generally in the horizontal direction so as to be spaced apart from each other and to extend in parallel, and vertical positions of image-forming units 2Y, 2M, 2C, 2K are respectively lower in this order (thus, the vertical position of image-forming unit 2Y is higher than that of image-forming unit 2K), whereby a plane in which image-forming units 2Y, 2M, 2C, 2K are arranged is inclined at a certain angle (e.g., 10 degrees) with respect to the horizontal direction. By this arrangement of image-forming units 2Y, 2M, 2C, 2K in a plane inclined with respect to the horizontal direction, the horizontal dimension is reduced in comparison with a case where image-forming units 2Y, 2M, 2C, 2K are arranged in a horizontal plane.

Each of the four image-forming units 2Y, 2M, 2C, 2K has basically the same structure, and contains photosensitive drum 3 that is driven to rotate about a rotation shaft 3A (see FIG. 3) at a certain speed and that serves as an image-holding member, primary charging roll 4 that charges a surface of photosensitive drum 3, developer unit 6 that develops, with toner, an electrostatic latent image formed on photosensitive drum 3 as a result of image exposure performed by exposure unit 5 (described later), and cleaning unit 7 that cleans the surface of photosensitive drum 3. Photosensitive drum 3 is constituted, for example, of an organic photosensitive member having a cylindrical shape with a diameter of 30 mm, and having an overcoat layer on its surface. Photosensitive drum 3 is rotated by a drive motor (not shown in the drawings), which serves as a drive unit. Charging roll 4 is, for example, a roll-shaped charger constituted of a core bar coated with a conductive layer made of a synthetic resin or rubber and having an adjusted electric resistance, and a charging bias is applied to the core bar of charging roll 4. Further, a cleaning roll for removing foreign matter such as toner adhering to a surface of charging unit 4 is arranged to contact the surface of charging roll 4.

In the following description, where it is not necessary to distinguish between image-forming units 2Y, 2M, 2C, 2K, the image-forming units will be simply referred to as image-forming unit(s) 2.

Below image-forming units 2, exposure unit 5 is provided to perform exposure in accordance with image data. Exposure unit 5 has four semiconductor laser units (not shown in the drawings) for emitting laser beams modulated in accordance with the image data. The four laser beams emitted from these semiconductor laser units are deflected by a polygon mirror for scanning, and are irradiated onto photosensitive drum 3 of each image-forming unit 2 via optical elements such as a lens and a mirror (not shown in the drawings). Exposure unit 5 extends along an underside of the four image-forming units 2, which, as mentioned in the foregoing, are arranged in a plane inclined with respect to the horizontal direction. Thus, a length of a light path of the laser beam irradiated onto photosensitive drum 3 is the same for each of image-forming units 2Y, 2M, 2C, and 2K.

Exposure unit 5, which is provided in common to each image-forming unit 2, receives image data of respective colors sequentially from the image-processing unit. The laser beam emitted from exposure unit 5 in accordance with the image data is irradiated onto a surface of corresponding photosensitive drum 3 to form an electrostatic latent image thereon. The electrostatic latent images formed on photosensitive drums 3 for respective colors are developed by developer units 6Y, 6M, 6C, 6K to form toner images of respective colors. The toner images of respective colors formed sequentially on photosensitive drums 3 of image-forming units 2 are transferred one on top of another by primary transfer rolls 11 to intermediate transfer belt 10, which is arranged obliquely over the top of each image-forming unit 2, and serves as an intermediate transfer member.

Intermediate transfer belt 10 is an endless belt-shaped member tension-supported by multiple rolls. Specifically, intermediate transfer belt 10 is wound around drive roll 12, backup roll 13, tension roll 14, and idler roll 15, such that intermediate transfer belt 10 is circulatingly moved in a direction indicated by an arrow in FIG. 1 by drive roll 12, which is rotated by a dedicated drive motor (not shown in the drawings) capable of maintaining a constant rotation speed. Intermediate transfer belt 10 has an upper moving section and a lower moving section, and the lower moving section is inclined with respect to the horizontal direction, with a downstream end of the lower moving section positioned lower than an upstream end of the same with respect to the direction of movement of the lower moving section. As intermediate transfer belt 10, a flexible film made of a synthetic resin, such as polyimide, may be used, where the ends of the synthetic resin film are connected by means of welding or the like to form an endless belt member. Intermediate transfer belt 10 is arranged such that the lower moving section is in contact with photosensitive drums 3Y, 3M, 3C, 3K of image-forming units 2Y, 2M, 2C, 2K.

It is to be noted that intermediate transfer belt 10, primary transfer rolls 11, drive roll 12, backup roll 13, tension roll 14, idler roll 15, etc., are integrated into a single unit referred to as intermediate transfer unit 9.

At a position opposed to backup roll 13 across intermediate transfer belt 10 is provided secondary transfer roll 17, which is urged against intermediate transfer belt 10. Secondary transfer roll 17 functions to cause the toner images, which have been primary-transferred onto intermediate transfer belt 10, to be secondary-transferred onto recording sheet 18, which serves as a recording medium. Specifically, when recording sheet 18 moves between secondary transfer roll 17 and intermediate transfer belt 10, secondary transfer roll 17 presses recording sheet 18 against intermediate transfer belt 10, whereby the toner images of yellow (Y), magenta (M), cyan (C), and black (K), which have been overlappingly transferred onto intermediate transfer belt 10, are transferred onto recording sheet 18 owing to pressure and electrostatic force. Recording sheet 18 on which the toner images of respective colors have been transferred is conveyed upward to fixing unit 19. Fixing unit 19 applies a heat and pressure to recording sheet 18 to fix the toner images of respective colors onto recording sheet 18. Thereafter, recording sheet 18 passes through exit roll 20 of fixing unit 19, and is conveyed through sheet-discharging path 21 to discharge roll 22, from which recording sheet 18 is discharged onto sheet-receiving tray 23 provided at an upper portion of image-forming apparatus 1.

Recording sheets 18, having a prescribed size and being made of a prescribed material, are contained in sheet container 24 disposed inside image-forming apparatus 1, and are conveyed, one sheet at a time, from sheet container 24 to registration roll 28 by means of sheet supply roll 25 and a pair of rolls 26 for sheet separation and conveyance. From there, recording sheet 18 is further conveyed to the secondary transfer position defined between intermediate transfer belt 10 and secondary transfer roll 17 by registration roll 28, which is rotated at a predetermined timing.

Arranged between sheet-receiving tray 23 and intermediate transfer belt 10 are toner cartridges 29Y, 29M, 29C, 29K serving as toner containers. Toner cartridges 29Y, 29M, 29C, and 29K supply toner to developer units 6Y, 6M, 6C, and 6K, respectively.

<Configuration of Housing>

Figure 2:
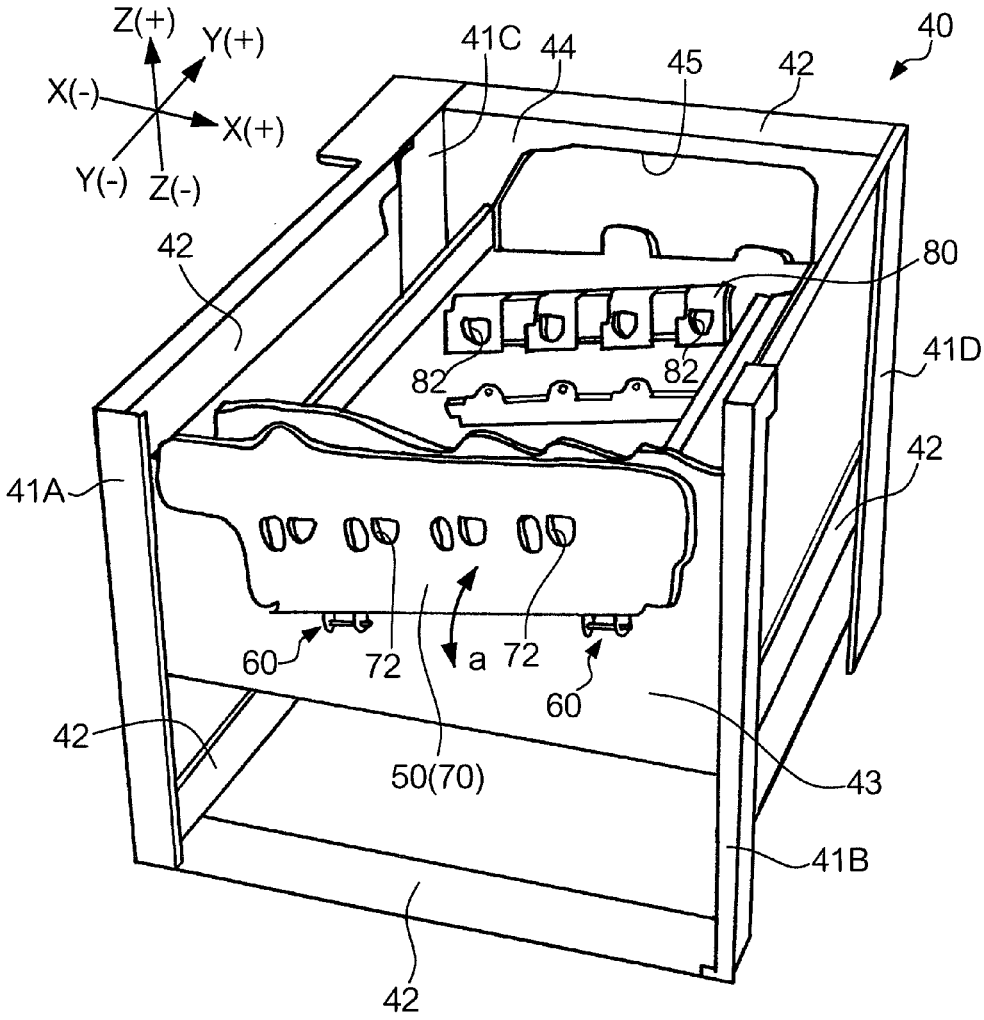
FIG. 2 is a perspective view showing a configuration of a housing.

Next, explanation will be made of a configuration of a main body (or housing) 40 of image-forming apparatus 1, with reference to FIG. 1 and FIG. 2. FIG. 2 is a perspective view schematically showing a configuration of main body 40, which defines an outer shape of image-forming apparatus 1.

As shown in FIG. 2, main body 40 includes four pillars 41A-41D extending in the vertical direction (Z-axis direction), and plural beams 42 connecting between pillars 41A-41D. Further, front frame 43 serving as a first frame member is provided between upper parts of front-side (or Y(−) side) pillars 41A, 41B, and back frame 44 serving as a second frame member is provided between upper parts of back-side (or Y(+) side) pillars 41C, 41D. Thus, front and back frames 43, 44, which are structural members of main body 40, are opposed to each other. Back frame 44 is formed with through-hole 45 having a generally rectangular shape. Front frame 43 is provided with a front cover 50 that is moveable in directions indicated by arrow "a" to open and close opening 46 (see FIG. 3).

Further, as shown in FIG. 1, main body 40 includes upper partition plate 47 that extends between frames 43 and 44 of main body 40 at a position above exposure unit 5 (or a position on a Z(+) side of exposure unit 5), to define a space in which exposure unit 5 is accommodated, where upper partition plate 47 is secured to frames 43 and 44 by means of welding or the like.

Front cover 50 attached to front frame 43 so as to be opened and closed includes first supporting plate 70 having first rotation shaft insertion holes 72, as shown in FIG. 2. Though not shown in the drawings, front cover 50 may have an outer plate-shaped member made of plastic or the like attached to an outer surface (or a surface facing in Y(−) direction) of first supporting plate 70. Back frame 44 is provided on its inner surface (a surface facing in Y(−) direction) with second supporting plate 80 having second rotation shaft insertion holes 82.

<Configuration of Front Cover 50 (First Supporting Plate 70) and Cover-Supporting Mechanisms 60>

Explanation will now be made of front cover 50 (first supporting plate 70) and cover-supporting mechanisms 60.

Figure 3:
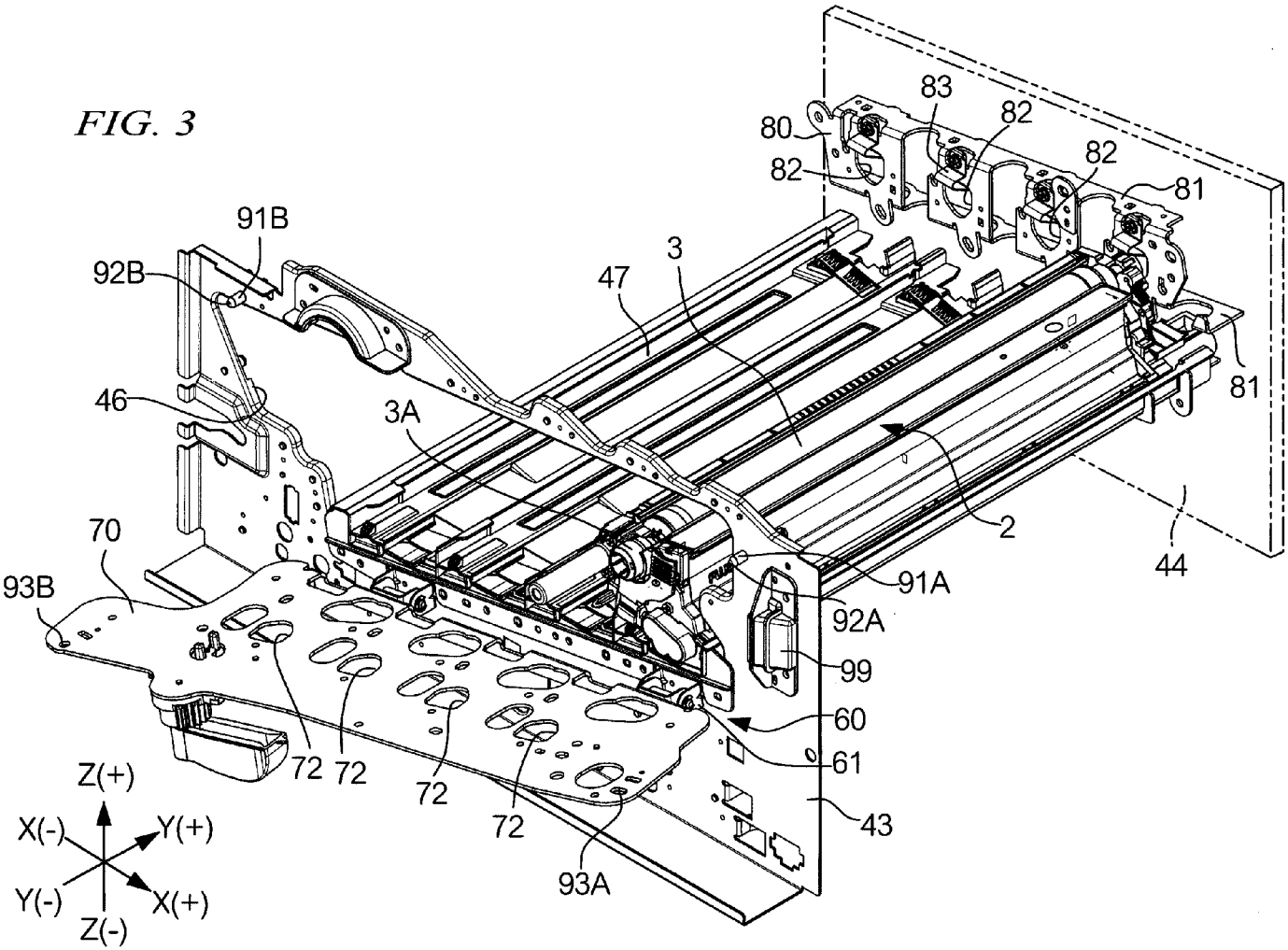
FIG. 3 is a perspective view showing an image-forming unit installed in a main body of the image-forming apparatus.
Figure 4:
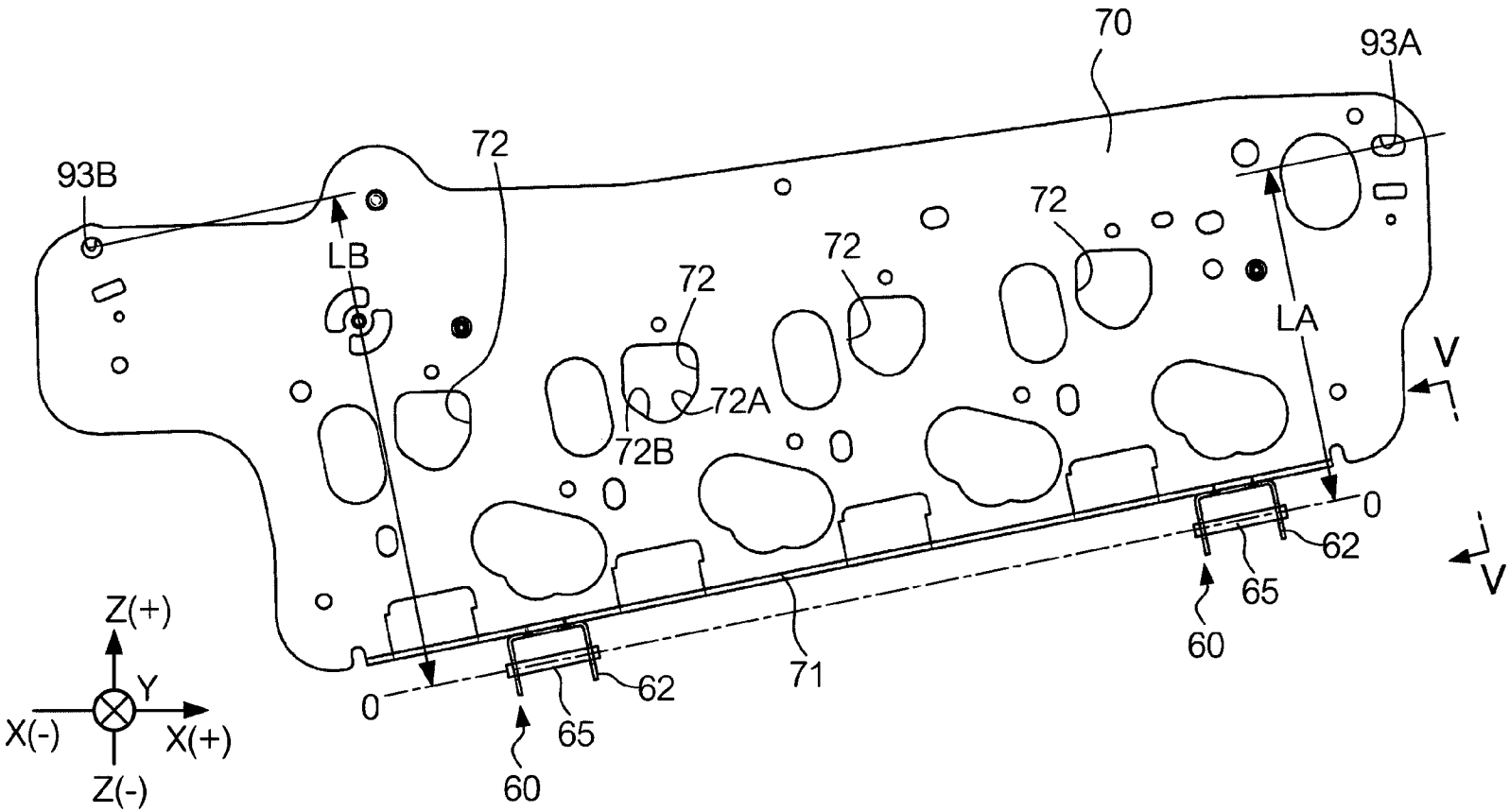
FIG. 4 is a plan view showing a first supporting plate.
Figures 5, 6:
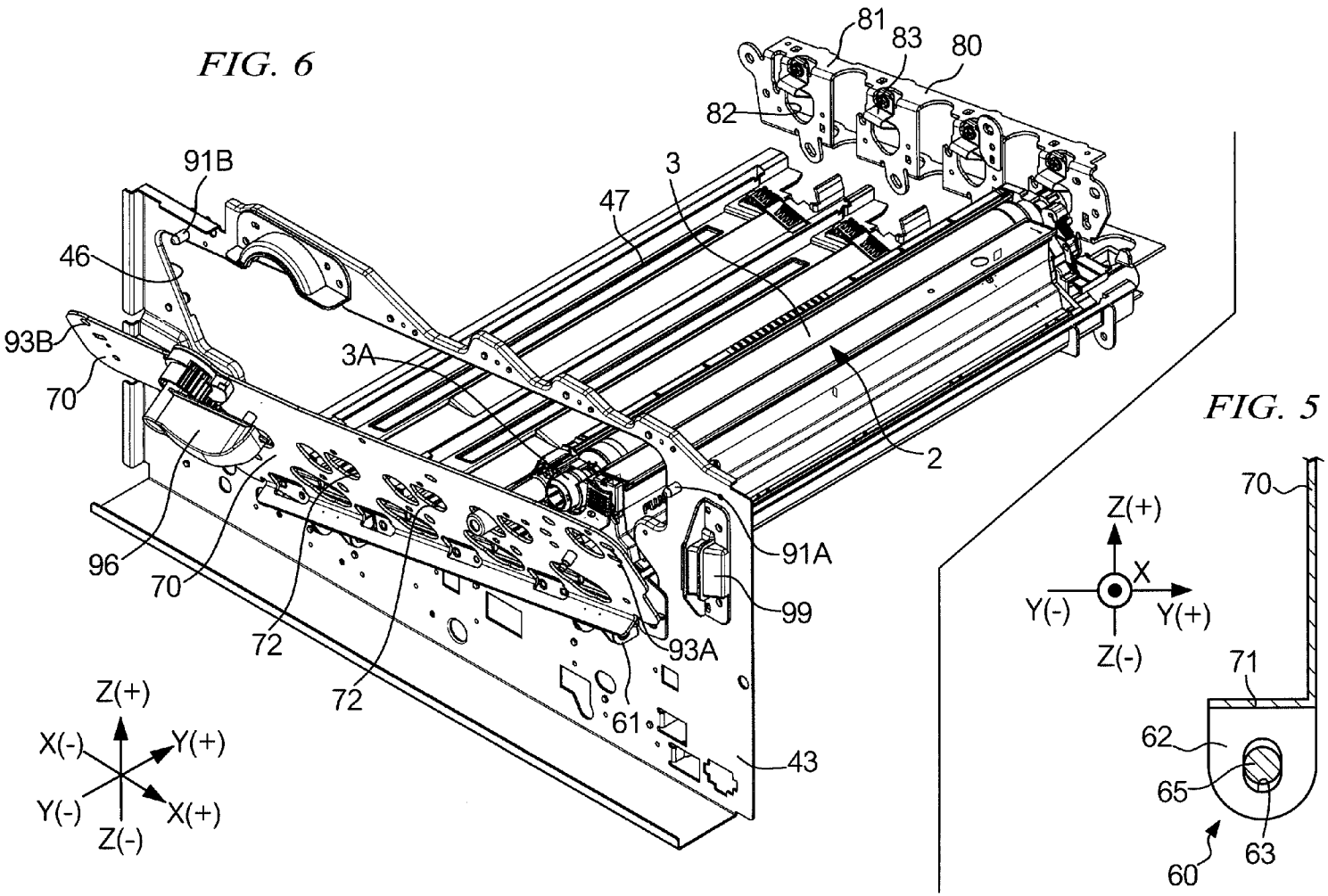
FIG. 5 is a side view of a cover-supporting mechanism viewed in a direction indicated by arrows V-V in FIG. 4.
FIG. 6 is a perspective view similar to FIG. 2, and shows the cover moved partially toward the closed position.

FIG. 3 is a perspective view showing image-forming units 2 in a state as when installed in main body 40 of image-forming apparatus 1, FIG. 4 is a plan view showing first supporting plate 70, and FIG. 5 is a side view seen in a direction indicated by arrows V-V in FIG. 4.

As shown in FIGS. 2 and 3, front cover 50 is attached to front frame 43 via a pair of cover-supporting mechanisms 60 that support a lower part of front cover 50 as a pivot center, whereby front cover 50 is pivotable in directions indicated by arrow "a," to open and close a space defined inside of main body 40 and having opening 46 with respect to an outside. In this space, four image-forming units 2 are arranged such that a longitudinal direction of each image-forming unit 2 (or an axis direction of photosensitive drum 3) extends in the front-back direction of image-forming apparatus 1 (or in the Y-axis direction). In a state where image-forming units 2 are installed in the space and opening 46 is closed by front cover 50, rotation shaft 3A of each photosensitive drum 3 is supported between first supporting plate 70 and second supporting plate 80. In this supported state, each image-forming unit 2 is spaced apart from upper partition plate 47.

In a case where image-forming apparatus 1 is set on a non-planar or non-horizontal surface, for example, the frames of image-forming apparatus 1 may deform to create a flexure portion in upper partition plate 47. This may cause the flexure portion of upper partition plate 47 to contact image-forming units 2 whereby positions of photosensitive drums 3 can become changed relative to each other, which in turn can result in misaligned transfer of toner images of respective colors onto recording medium 18. In image-forming apparatus 1 according to this exemplary embodiment, each image-forming unit 2 is held to be spaced apart from upper partition plate 47, and thus, contact of a flexure portion of upper partition plate 47 to image-forming units 2 is avoided and any change in relative positions between photosensitive drums 3 is suppressed.

Each cover-supporting mechanism 60 includes bracket 61 protruding in the frontward direction (or Y(−) direction) from front frame 43, supporting piece 62 protruding from first supporting plate 70, and supporting shaft 65. Each of brackets 61 and supporting pieces 62 has a pair of opposing walls connected by a connection wall, such that the cross-sectional shape is substantially of a shape of a symbol "U," and is formed with a supporting shaft insertion hole in the opposing walls. Supporting shaft 65 is inserted into supporting shaft insertion holes of bracket 61 and supporting piece 62 of each cover-supporting mechanism 60, thereby to pivotably attach first supporting plate 70 (front cover 50) to front frame 43. As shown in FIG. 4, in cover-supporting mechanisms 60, 60, an axis direction of each supporting shaft 65 corresponds to a pivot axis O-O of front cover 50, which is inclined with respect to the horizontal direction by an angle (e.g., 10 degrees) that is substantially equal to the inclination angle of the plane in which image-forming units 2 are arranged.

Each supporting shaft 65 has a round cross-section as shown in FIG. 5, and a supporting shaft insertion hole (not shown in the drawings) formed in each bracket 61 also has a round shape. On the other hand, supporting shaft insertion hole 63 formed in each supporting piece 62 is an elongated hole having rounded ends, the hole being elongated in a direction having a vertical component (or elongated in an at least partially vertical direction) when front cover 50 is closed to close the space. Concretely, supporting shaft 65 has a circular cross-section having a diameter of 5 mm, and supporting shaft insertion hole 63 is an elongated hole with a shorter-axis dimension of 5 mm and a longer-axis dimension of 6 mm. This elongated hole may have an oval shape, consisting of two congruent semi-circles spaced apart by two equal and parallel sides.

Explanation will now be made of first supporting plate 70. As shown in FIG. 4, first supporting plate 70 is made of a substantially rectangular plate member. Along one longitudinal side of first supporting plate 70 is formed rib 71 to which supporting pieces 62, 62 of cover-supporting mechanisms 60, 60 are provided. Further, first rotation shaft insertion holes 72 each having a substantially pentagonal shape and receiving rotation shaft 3A of corresponding photosensitive drum 3 are formed so as to extend in a direction of thickness of the plate member at such positions that perpendicular line segments from respective first rotation shaft insertion holes 72 to pivot axis O-O have the same length. In this way, when front cover 50 is pivoted around pivot axis O-O to close opening 46, end portions of rotation shafts 3A begin to be inserted into respective first rotation shaft insertion holes 72 at the same timing. As shown in FIG. 9, each rotation shaft 3A has tapered end portion 3B, such that the diameter reduces toward the end, to facilitate insertion of the end portion of rotation shaft 3A into first rotation shaft insertion hole 72.

First supporting plate 70 and second supporting plate 80 are composed of metallic plates made of the same material and having the same thickness. When rotation shaft insertion holes 72, 82 are bored, the boring is performed on first supporting plate 70 and second supporting plate 80 stacked one over the other. In this way, burrs and distortions that may be generated as a result of the boring can be substantially the same between corresponding rotation shaft insertion holes 72, 82. This contributes to suppressing a positional misalignment between the ends of each rotation shaft 3A.

Further, as shown in FIG. 4, each first rotation shaft insertion hole 72 has oblique edge segments 72A, 72B, which are asymmetric with respect to an axis extending in the vertical direction (or the Z-axis). Specifically, left oblique edge segment 72B has a larger inclination angle with respect to the Z-axis than right oblique edge segment 72A. In this way, even if tapered end portion 3B of rotation shaft 3A is inclined downward in the frontward direction (or Y(−) direction), end portion 3B is easily inserted into first rotation shaft insertion hole 72.

As shown in FIG. 3, second supporting plate 80 is formed by bending a substantially rectangular plate member such that second supporting plate 80 has ribs 81, 81 formed along its longitudinal sides so as to project in the outward direction (Y(+) direction), and an end of each rib 81, 81 is fixedly attached to an inner surface of back frame 44 by means of laser-welding or the like. Second supporting plate 80 is formed with second rotation shaft insertion holes 82, . . . , 82 each having a substantially pentagonal shape and receiving rotation shaft 3A of corresponding photosensitive drum 3 such that insertion holes 82, . . . , 82 are arranged along a longitudinal direction of second supporting plate 80 (or in the X-axis direction). Further, bias spring 83 is provided to an inner surface (a surface facing in the Y(−) direction) of a part of second supporting plate 80 above each second rotation shaft insertion hole 82. This bias spring 83 is a spring formed by bending a plate to have a cross-section substantially in a shape of a chevron, and attached to second supporting plate 80 such that the bent portion projects inward and a portion between the bent portion and a free end extends in the outward direction (Y(+) direction) into corresponding second rotation shaft insertion hole 82 to serve as a pressing member. Owing to such a structure, the end portion of rotation shaft 3A inserted into second rotation shaft insertion hole 82 is pressed in the downward direction (Z(−) direction) by bias spring 83.

Next, explanation will be made of cover-positioning mechanisms 90A, 90B. As shown in FIG. 3, positioning mechanisms 90A, 90B are provided at an upper portion of front frame 43 and are spaced apart from each other in the direction of pivot axis O-O (X-axis direction). It is to be noted that component parts of right positioning mechanism 90A are denoted by reference numerals suffixed with a letter "A," and component parts of left positioning mechanism 90B are denoted with reference numerals suffixed with a letter "B". However, when it is not necessary to distinguish between them, the letters are omitted.

Positioning mechanisms 90 include positioning pins 91 provided to an upper portion of front frame 43 to project therefrom, and positioning holes 93 formed in first supporting plate 70. Thus, positioning pins 91 serve as projections, and positioning holes 93 serve as projection insertion holes. Each positioning pin 91 has tapered end portion 92 such that its diameter decreases toward a free end. During movement of first supporting plate 70 for closing opening 46, positioning pins 91 are sequentially inserted into corresponding positioning holes 93. A length of positioning pin 91 that projects from front frame 43 is the same for each of positioning mechanisms 90A and 90B.

Positioning mechanisms 90A and 90B are arranged such that length LA of a perpendicular line segment from positioning mechanism 90A to pivot axis O-O is shorter than length LB of a perpendicular line segment from positioning mechanism 90B to pivot axis O-O. Thus, when front cover 50 is closed to close opening 46, pin 91A closer to pivot axis O-O begins to be inserted into positioning hole 93A first, and thereafter, pin 91B that is further distant from pivot axis O-O begins to be inserted into positioning hole 93B. Thus, positioning pin 91 is inserted into positioning hole 93 at different timings for positioning mechanisms 90A and 90B, and this reduces an impact caused when positioning pin 91 is inserted into positioning hole 93.

It is also to be noted that positioning hole 93A on the right (X(+) side), which receives pin 91A positioned to have short length LA of perpendicular line segment to pivot axis O-O, is elongated in a direction having a horizontal (X-axis direction) component and has rounded ends. This allows easy insertion of positioning pin 91A into positioning hole 93A in positioning mechanism 90A for which the positioning operation is conducted first. Because positioning hole 93A has a long dimension in the horizontal direction (X-axis direction) and a short dimension in the vertical direction (Z-axis direction), the insertion of positioning pin 91A into positioning hole 93A causes front cover 50 (first supporting plate 70) to move upward (in the Z(+) direction). Further, even if front cover 50 is inadvertently moved in a direction of extension of supporting shafts 65, positioning pin 91A is readily inserted into positioning hole 93A.

Figure 10A:
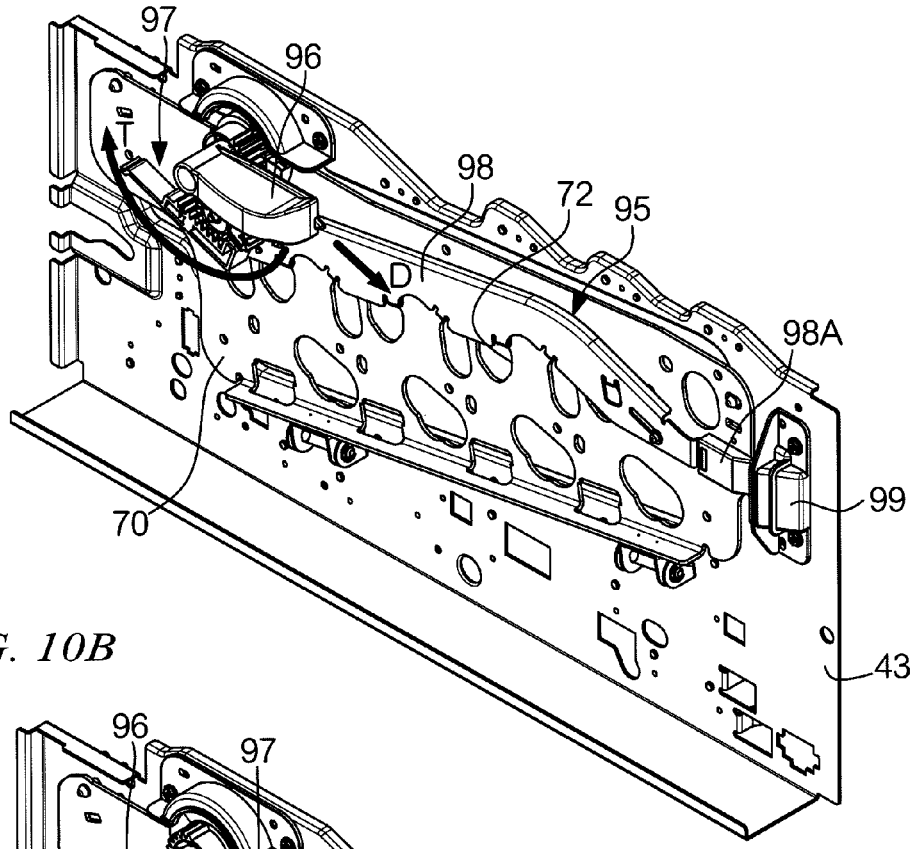
FIGS. 10A and 10B are perspective views showing an operation of a locking mechanism for the cover.
Figure 10B:
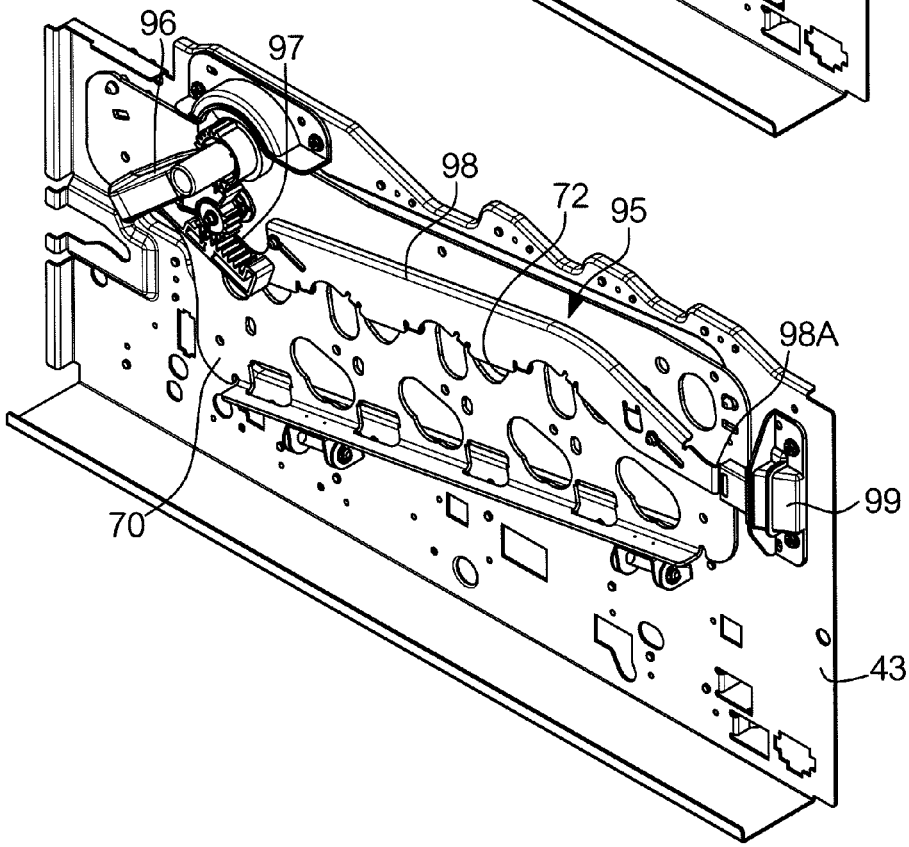

Further, on an outer side of first supporting plate 70, lock mechanism 95 is provided to securely hold front cover 50 closing opening 46 and press an end portion of rotation shaft 3A in the downward direction (Z(−) direction). As shown in FIGS. 10A and 10B, this lock mechanism 95 includes lever 96 rotatable in a direction indicated by arrow T, moveable plate 98 engaging with lever 96 via gear train 97 and having one end formed with latch bolt 98A, and strike 99 provided to front frame 43 for engagement with latch bolt 98A. When lever 96 of lock mechanism 95 is rotated in the direction indicated by arrow T after front cover 50 closes opening 46, latch bolt 98A is moved in a direction indicated by arrow D to be inserted into strike 99, to secure front cover 50 to front frame 43. Further, a bias spring (not shown in the drawings) provided to moveable plate 98 presses an end portion of rotation shaft 3A, which has been inserted into first rotation shaft insertion hole 72, in the downward direction (Z(−) direction), to thereby securely hold the end portion of rotation shaft 3A.

<Operation of First Supporting Plate 70 for Supporting of Photosensitive Drum 3>

Figure 7:
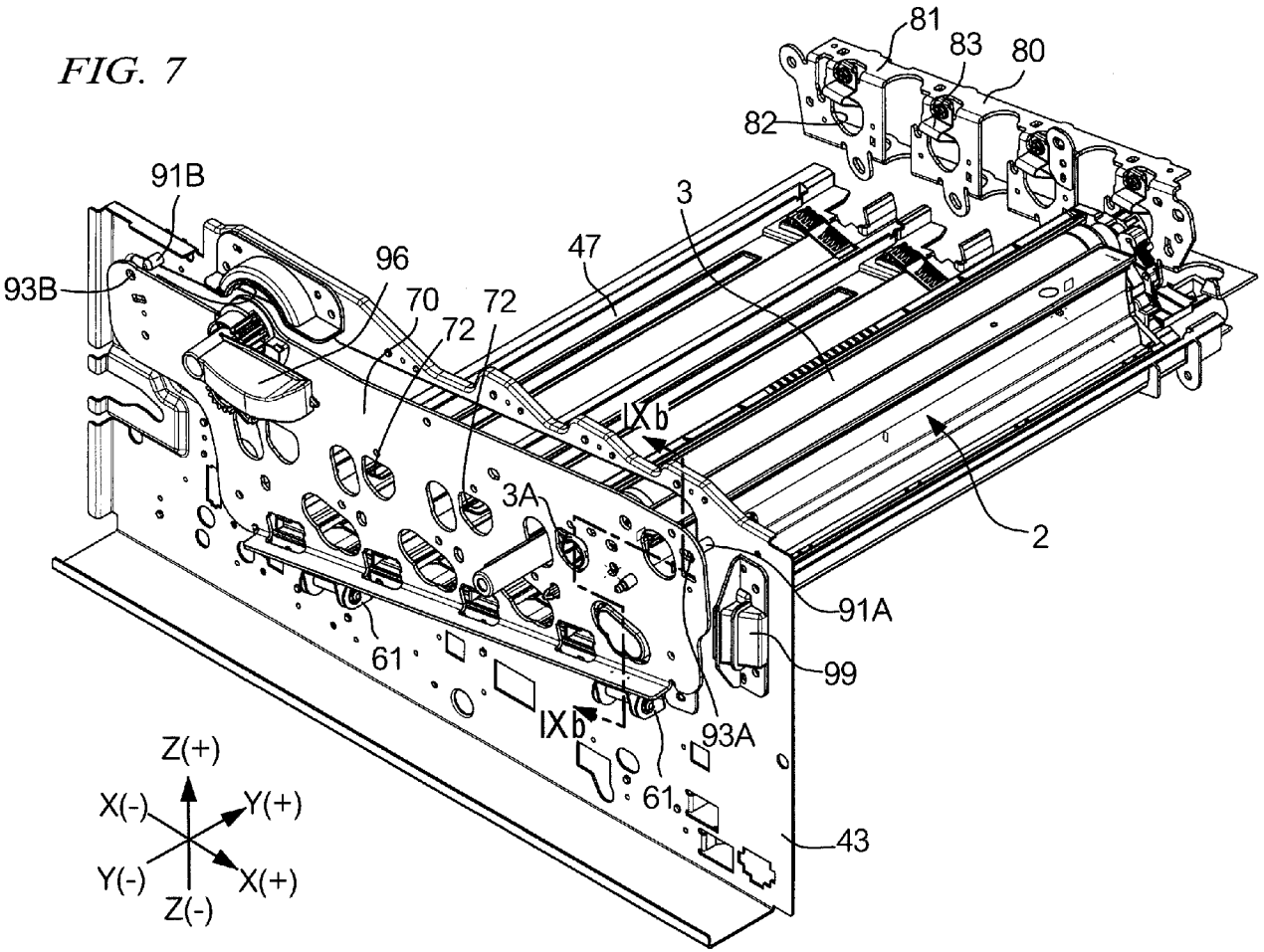
FIG. 7 is a perspective view similar to FIG. 6, and shows the cover moved closer to the closed position than in FIG. 6.
Figure 8:
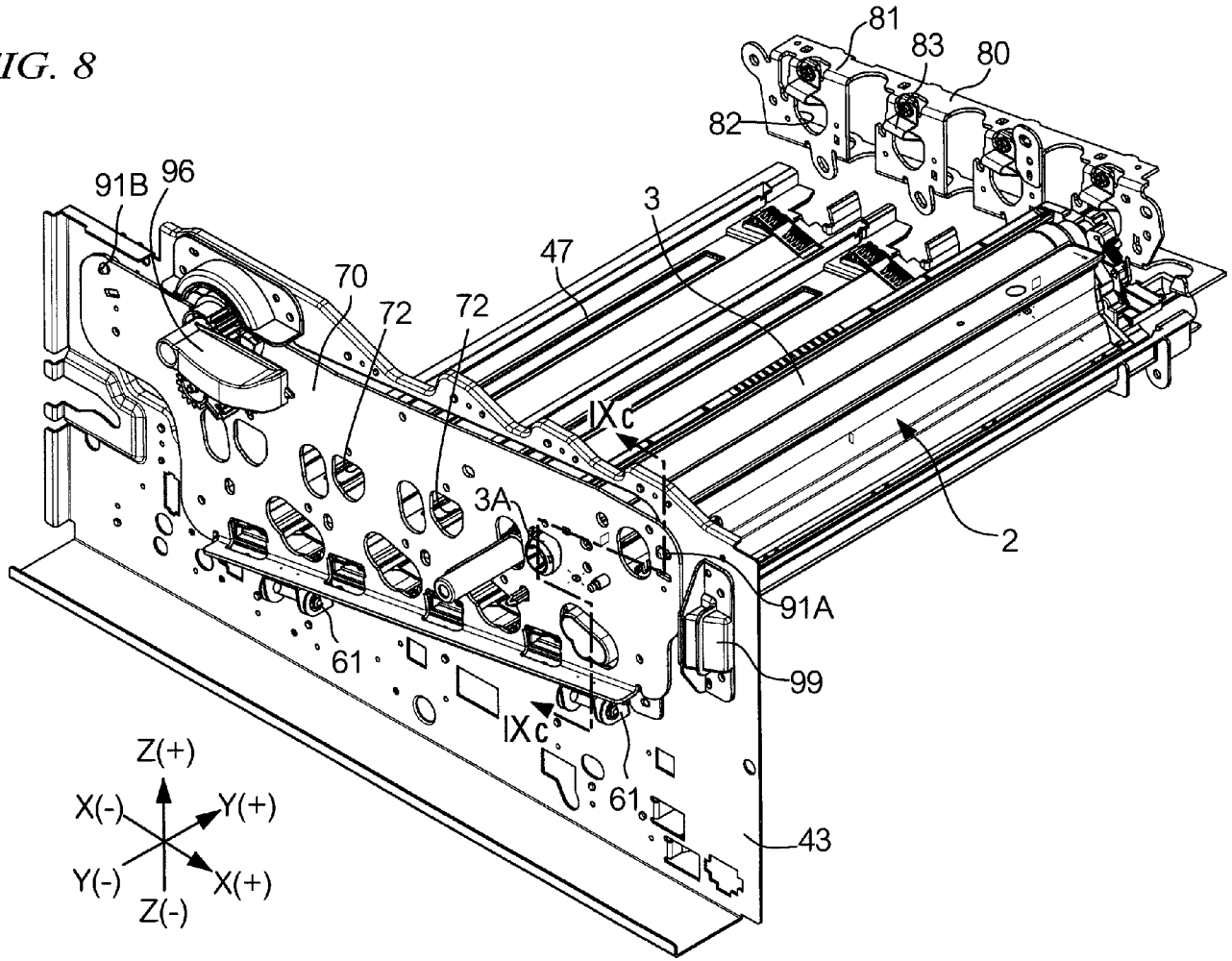
FIG. 8 is a perspective view similar to FIG. 6, and shows the cover moved closer to the closed position than in FIG. 7.
Figure 9C:
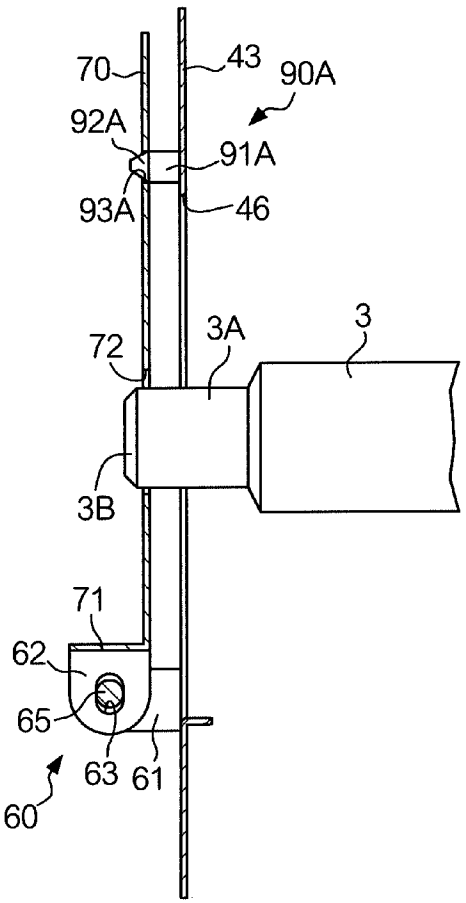
FIGS. 9A-9C are cross-sectional views taken along line IXb-IXb of FIG. 7 or line IXc-IXc of FIG. 8 showing movement of the cover in a vicinity of the closed position.
Figure 9B:
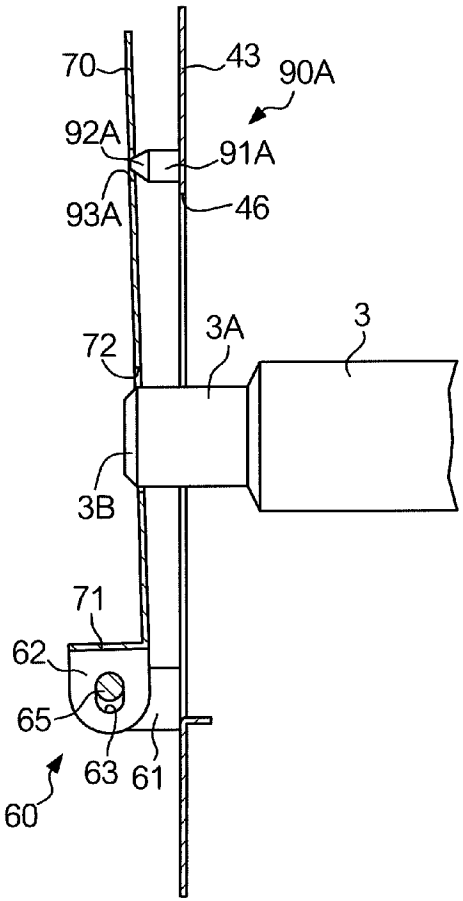
Figure 9A:
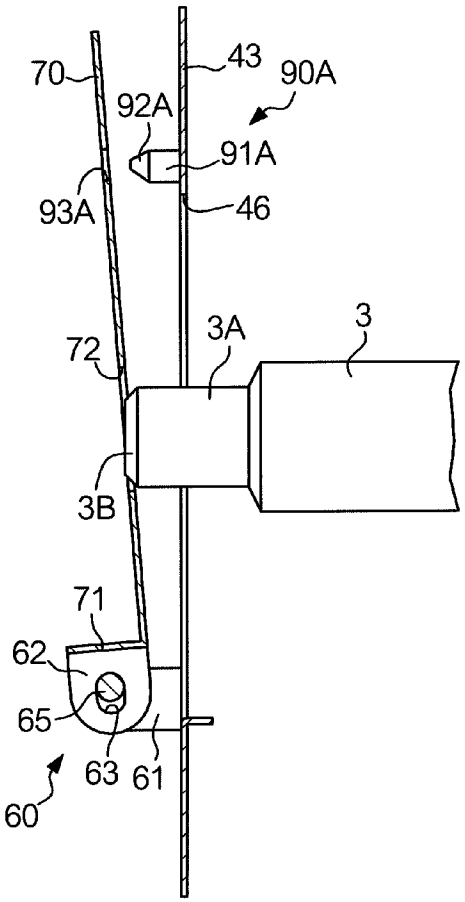

Explanation will now be made of an operation of first supporting plate 70 for supporting of rotation shaft 3A of photosensitive drum 3, with reference to FIG. 3, FIGS. 6-8, and FIGS. 9A-9C. FIGS. 6-8 are perspective views showing an operation of first supporting plate 70 moving toward the position where first supporting plate 70 closes opening 46. FIGS. 9A-9C are cross-sectional views taken along line IXb-IXb of FIG. 7 or line IXc-IXc of FIG. 8 to show movement of first supporting plate 70 in a vicinity of the closed position.

First, as shown in FIG. 3, in a state where first supporting plate 70 is opened to open opening 46, each image-forming unit 2 is inserted along upper partition plate 47 into the space defined between frames 43 and 44. It is to be noted that in FIGS. 3, 6-8, and 9A-9C, only a single image-forming unit 2 is shown, and illustration of the other three image-forming units 2 is omitted. In this state, an end of each image-forming unit 2 facing in a direction of insertion (or an end facing in the backward direction) is received in corresponding second rotation shaft insertion hole 82 of second supporting plate 80, and thus each image-forming unit 2 is inclined downward in the frontward direction (Y(−) direction).

It is also to be noted that when front cover 50 (first supporting plate 70) is opened to be located in the horizontal plane (X-Y plane), the shorter axis of supporting shaft insertion hole 63 of cover-supporting mechanism 60 extends in the vertical direction (Z-axis direction) and the longer axis of the same extends in the front-back direction (Y-axis direction), and thus, front cover 50 can move in Y(+) and Y(−) directions within a range allowed by the longer-axis dimension of supporting shaft insertion hole 63.

Then, first supporting plate 70 (front cover 50) begins to be rotated in the direction indicated by arrow "a" to close opening 46. As the surface of first supporting plate 70 (front cover 50) comes closer to being in parallel with the direction of gravity (Z-axis direction), the longer axis of supporting shaft insertion hole 63 also comes closer to being in parallel with the direction of gravity (Z-axis direction). As a result, as shown in FIG. 9A, front cover 50 (first supporting plate 70) moves downward due to its own weight, whereby a part of supporting piece 62 defining one end of supporting shaft insertion hole 63 in the longer-axis direction (an upper end (or Z(+)-side end) in FIG. 9A) contacts supporting shaft 65. As front cover 50 (first supporting plate 70) is further rotated from this state, tapered end portion 3B of each rotation shaft 3A begins to be inserted into corresponding one of first rotation shaft insertion holes 72, which are positioned close to pivot axis O-O in comparison with positioning holes 93A, 93B. By this insertion process, an underside (Z(−)-side surface) of tapered end portion 3B contacts a lower part (Z(−)-side part) of an edge of first rotation shaft insertion hole 72, as shown in FIG. 9A. Because supporting shaft 65 prevents first supporting plate 70 from moving downward (in Z(−) direction), tapered end portion 3B of rotation shaft 3A moves upward (in Z(+) direction) as first supporting plate 70 advances toward the closed position.

Subsequently, as shown in FIG. 9B, tapered end portion 92A of positioning pin 91A of positioning mechanism 90A is inserted into positioning hole 93A. When tapered end portion 92A begins to be inserted into positioning hole 93A, an upper part of an edge of positioning hole 93A contacts tapered end portion 92A, and thus, as the insertion proceeds, first supporting plate 70 moves upward (in Z(+) direction), as shown in FIG. 9C. Further, during the positioning operation in positioning mechanism 90A, positioning pin 91B of positioning mechanism 90B begins to be inserted into positioning hole 93B. When first supporting plate 70 (front cover 50) has moved to the position for closing opening 46, the positioning provided by positioning mechanisms 90A, 90B is completed.

As shown in FIG. 4, positioning hole 93A on the right (X(+) side) is elongated in the horizontal direction (X-axis direction) and has rounded ends, while positioning hole 93B on the left (X(−) side) is a round hole. Preferably, positioning hole 93A has an oval or elliptic shape. In such positioning mechanisms 90, when positioning pin 91A is inserted into positioning hole 93A first, the insertion is achieved easily and front cover 50 (first supporting plate 70) is moved up to a provisional position, and subsequently, when positioning pin 91B is inserted into positioning hole 93B, final positioning of front cover 50 is achieved.

Thereafter, lock mechanism 95 shown in FIGS. 10A and 10B is operated to secure first supporting plate 70 (front cover 50) to front frame 43, and to securely hold each rotation shaft 3A in corresponding first rotation shaft insertion hole 72 by means of moveable plate 98. In this way, the positioning of each rotation shaft 3A between supporting plates 70 and 80 is achieved, and each image-forming unit 2 is supported to be spaced apart from upper partition plate 47.

As described in the foregoing, positioning mechanisms 90A and 90B are arranged such that the length of the perpendicular line segment from positioning mechanism 90A to pivot axis O-O is shorter than the length of the perpendicular line segment from positioning mechanism 90B to pivot axis O-O, and thus, the positioning on the left is carried out after the positioning on the right is completed. Also, because positioning pin 91 is inserted into positioning hole 93 at different timings for positioning mechanisms 90A and 90B, an impact caused when positioning pin 91 is inserted into positioning hole 93 is reduced. Further, positioning hole 93A of positioning mechanism 90A is an elongated hole extending in the horizontal direction, and this allows easy insertion of positioning pin 91A with a reduced impact. Positioning hole 93A also functions to carry out positioning for moving front cover 50 (first supporting plate 70) upward. Thereafter, insertion of positioning pin 91B into positioning hole 93B in positioning mechanism 90B achieves final positioning of front cover 50 (first supporting plate 70) relative to front frame 43.

With regard to positioning of respective rotation shafts 3A, as front cover 50 is moved to the closed position, end portions 3B of rotation shafts 3A begin to be inserted into corresponding first rotation shaft insertion holes 72, which are at the same distance from pivot axis O-O. Then, when right positioning mechanism 90A begins to operate to move a right portion of front cover 50 to a normal position, left positioning mechanism 90B has yet to begin an operation for positioning, and thus, a left portion of front cover 50 is positioned lower than the right portion of the same. As front cover 50 is further rotated toward the closed position, left positioning mechanism 90B begins to operate to pull up the left portion of front cover 50 to the normal position. Thus, front cover 50 is moved to its normal position, with the right portion being pulled up first and the left portion being pulled up thereafter. Accordingly, rotation shafts 3A received in respective first rotation shaft insertion holes 72 are pulled up (or positioned) sequentially, with rotation shaft 3A received in the rightmost insertion hole 72 being pulled up first and rotation shaft 3A received in the leftmost insertion hole 72 being pulled up last. Thus, rotation shafts 3A received in first rotation shaft insertion holes 72 are pulled up at different timings, and this allows a user to close front cover 50 with a smaller force in comparison with a case where rotation shafts 3A are pulled up at the same time.

2. Modified Embodiments

The exemplary embodiment explained in the foregoing may be modified as described below.

<2-1>

In cover-supporting mechanism 60 of the exemplary embodiment, supporting shaft insertion hole 63 on the side of first supporting plate 70 is provided with an elongated shape to cause first supporting plate 70 to move downward (in Z(−) direction) as the surface of first supporting plate 70 comes closer to being in parallel with the direction of gravity (Z-axis direction) during closure operation of first supporting plate 70. However, the supporting shaft insertion hole formed in bracket 61 of front frame 43 may be elongated to achieve such downward movement of first supporting plate 70. Further, in the exemplary embodiment, the elongated hole has an oval shape, but it may be elliptic. Furthermore, the supporting shaft insertion hole may be of a rectangular shape or any other elongated shape so long as first supporting plate 70 can pivot around supporting shafts 65 and the shaft insertion hole allows first supporting plate 70 to move relative to front frame 43 in a direction of elongation of the shaft insertion hole.

<2-2>

In positioning mechanism 90 of the exemplary embodiment, positioning pin 91 is formed on front frame 43 to project therefrom, and positioning hole 93 is formed in first supporting plate 70. However, a positioning hole may be formed in front frame 43 and a positioning pin may be formed on first supporting plate 70 to project therefrom. Any structure that includes a projection(s) and a recess(es) for positioning first supporting plate 70 relative to front frame 43 may be utilized. Further, the exemplary embodiment includes a pair of positioning mechanisms that are spaced apart from each other in the direction of the pivot axis, but three or more positioning mechanisms may be provided.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming apparatus comprising:

a plurality of image-holding members, each image-holding member holding an image and being rotatable around a rotation shaft;

a frame member that at least partially defines a space for accommodating the plurality of image-holding members therein;

a cover provided to the frame member to open and close the space with respect to an outside, an inner side of the cover being formed with rotation shaft insertion holes each for receiving an end portion of the rotation shaft of a corresponding one of the image-holding members accommodated in the space;

a supporting shaft that supports the cover such that the cover is pivotable with respect to the frame member; and a positioning mechanism that positions the cover with respect to the frame member when the cover closes the space, the positioning mechanism including at least two projections that project from one of the frame member and the cover and that are spaced apart from each other in a direction of an axis of the supporting shaft such that lengths of perpendicular line segments from the at least two projections to the axis of the supporting shaft are different from each other, and projection insertion holes provided to the other one of the frame member and the cover to receive the corresponding projections when the cover closes the space.

2. The image-forming apparatus according to claim 1, wherein one of the projection insertion holes, which receives one of the projections having a shortest length of the perpendicular line segment to the axis of the supporting shaft, is an elongated hole extending in a direction having a horizontal component.

3. The image-forming apparatus according to claim 2, wherein the one of the projection insertion holes has an oval or elliptic shape.

4. The image-forming apparatus according to claim 1, wherein when the cover is moved toward a position for closing the space, the rotation shafts of the plurality of image-holding members are inserted sequentially into the corresponding rotation shaft insertion holes formed in the cover, with the rotation shaft closest to one of the projections having a shortest length of the perpendicular line segment to the axis of the supporting shaft being inserted first, and the rotation shaft closest to another one of the projections having a greatest length of the perpendicular line segment to the axis of the supporting shaft being inserted last.

5. The image-forming apparatus according to claim 1, wherein each projection has a tapered end portion such that a diameter of the projection reduces toward an end of the projection.

6. An image-forming apparatus comprising:

a plurality of image-holding members, each image-holding member holding an image and being rotatable around a rotation shaft;

a first frame member and a second frame member opposed to the first frame member, the first and second frame members at least partially defining a space therebetween for accommodating the plurality of image-holding members;

a cover provided to the first frame member to open and close the space with respect to an outside, an inner side of the cover being formed with first rotation shaft insertion holes each for receiving an end portion of the rotation shaft of a corresponding one of the image-holding members accommodated in the space, and an inner side of the second frame member being formed with second rotation shaft insertion holes each for receiving an end portion of the rotation shaft of a corresponding one of the image-holding members accommodated in the space;

a supporting shaft that supports the cover such that the cover is pivotable with respect to the first frame member; and a positioning mechanism that positions the cover with respect to the first frame member when the cover closes the space, the positioning mechanism including at least two projections that project from one of the first frame member and the cover and that are spaced apart from each other in a direction of an axis of the supporting shaft such that lengths of perpendicular line segments from the at least two projections to the axis of the supporting shaft are different from each other, and projection insertion holes provided to the other one of the first frame member and the cover to receive the corresponding projections when the cover closes the space.

7. The image-forming apparatus according to claim 6, wherein one of the projection insertion holes, which receives one of the projections having a shortest length of the perpendicular line segment to the axis of the supporting shaft, is an elongated hole extending in a direction having a horizontal component.

8. The image-forming apparatus according to claim 7, wherein the one of the projection insertion holes has an oval or elliptic shape.

9. The image-forming apparatus according to claim 6, wherein when the cover is moved toward a position for closing the space, the rotation shafts of the plurality of image-holding members are inserted sequentially into the corresponding rotation shaft insertion holes formed in the cover, with the rotation shaft closest to one of the projections having a shortest length of the perpendicular line segment to the axis of the supporting shaft being inserted first, and the rotation shaft closest to another one of the projections having a greatest length of the perpendicular line segment to the axis of the supporting shaft being inserted last.

10. The image-forming apparatus according to claim 6, wherein each projection has a tapered end portion such that a diameter of the projection reduces toward an end of the projection.

* * * * *